United States Patent [19]

Herndon

[11] 4,139,219

[45] Feb. 13, 1979

[54] MONEY MARKING SYSTEM

[75] Inventor: George N. Herndon, Macon, Ga.

[73] Assignee: Marked Money Systems, Inc., Macon, Ga.

[21] Appl. No.: 634,060

[22] Filed: Nov. 21, 1975

[51] Int. Cl.[2] ..... B42D 15/00

[52] U.S. Cl. ..... 283/57; 101/111

[58] Field of Search ..... 283/1, 57, 59; 101/111

[56] References Cited

U.S. PATENT DOCUMENTS

| | | | |
|---|---|---|---|
| 1,093,485 | 4/1914 | Scotford et al. | 101/111 |
| 1,118,814 | 11/1914 | Schmidt et al. | 101/111 |

FOREIGN PATENT DOCUMENTS

| | | | |
|---|---|---|---|
| 1177718 | 12/1958 | France | 283/57 |

*Primary Examiner*—Stephen C. Pellegrino

*Attorney, Agent, or Firm*—Kenyon & Kenyon, Reilly, Carr & Chapin

[57] ABSTRACT

A system for marking money to permit stolen money to be traced to its source in which each bill received by a business is stamped with a two part code including a date and a business identification number whereby, upon a theft, the date and identifying number can be distributed permitting others receiving the money to identify it as being stolen.

3 Claims, 3 Drawing Figures

MONEY MARKING SYSTEM

BACKGROUND OF THE INVENTION

This invention relates to theft prevention and detection in general in more particularly to an improved system for marking money to allow it to be traced to a business from which it was stolen.

With the rising crime rate, the number of thefts or money from businesses has increased drasticly. Currency, by its nature, is difficult to identify except by serial number. Banks and other groups dealing with large amounts of currency do often record serial numbers in a case a theft should occur. However, a small business which is constantly dealing with money coming in and going out cannot keep track of serial numbers. As a result, if there is a theft from a business two problems occur. The first problem is in catching the thief. If the thief goes otherwise undetected it is unlikely that simply passing the stolen money will result in detection since it is good money and cannot be differentiated from money which he came by legally. A second problem arises in that, even if the thief is caught, it may not be possible to identify the source of his money. It is very likely that he has robbed a number of establishments and all of the money will be mixed together. In some cases it may not even be possible to prove that he is the thief who was responsible for a robbery other than the one in connection with which he was caught.

In view of these various factors, there is an undeniable need to, first, prevent as many of these thefts as possible and, second to provide a means to aid in detecting thefts and in returning stolen money to its proper owner.

SUMMARY OF THE INVENTION

The present invention provides such a system. In accordance with the present invention, each business wishing to take advantage of the protection afforded is equipped with one or more devices for stamping a group of numbers on the borders of currency received by that business. All currency received, or if desired only bills of larger denomination, are stamped on their edge or border with a two part code including a date and a code identifying the business. Stamping is done starting at the upper left hand corner of the green side of the bill and continuing clockwise. When the green side of the bill is filled up it is turned over and stamping continued in the same manner on the other side. This permits the bill to go through 20 different stampings, at which time it will normally be in a state where it is normally replaced in any case. Stamping is done with an indelible ink to prevent erasure of the code. Futhermore it is preferable that the merchant take steps to let the prospective thief know that he is using the system. This knowledge along with the remainder of the system of the present invention in the first instance act as a deterrent to the criminal. Furthermore, should the criminal disregard the warning and still rob the merchant, the money can be easily identified to aid in catching the thief and returning the money to the proper owner.

Once the money is marked, if a theft occurs, the owner need only notify the police of the date on which the theft occurred and his identifying number. This information can be widely distributed to other merchants, banks etc. They then need only briefly examine each piece of currency they receive to note whether or not that identifying number and date are on a bill. If so, they can contact the proper authorities to aid in catching the thief.

Detailed Description of the Preferred Embodiment

Figure 1:
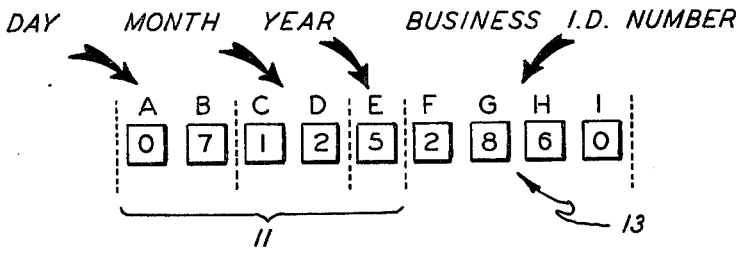
FIG. 1 is a drawing illustrating the arrangement of the code of the present invention.

As indicated above, the system of the present invention depends on marking each bill received by a merchant with a two part code, the first part indicating the date and second part a business identification number. Illustrated on FIG. 1. is this code. Shown is the first group of five numbers divided into subgroups of two numbers, two numbers and one number. As shown, the first two numbers in the columns A and B are for entering day of the month, the next two columns C and D for entering the month and last column E of the first group for entering the last digit of the year. The second group of numbers indicated as 13 on the drawing and including the columns F, G, H and I are for a business I.D. number. Although, four numbers are shown for this purpose a smaller or larger group of numbers may also be used.

Figure 2:
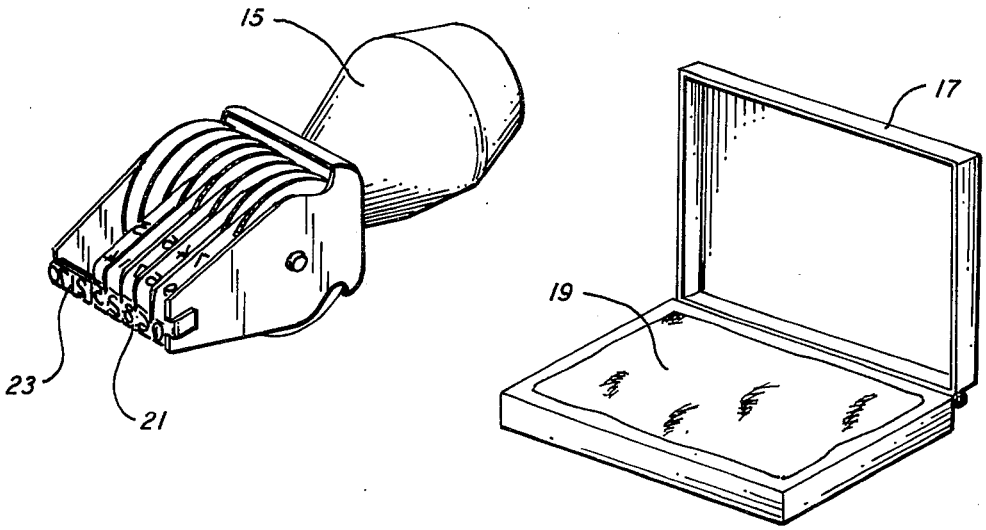
FIG. 2 is a perspective view of the apparatus used in marking currency according to the present invention.

Shown in FIG. 2 is the apparatus used in marking currency according to the present invention. This includes an encoderdater 15 and stamp pad 17 having a pad 19 therein impregnated with indelible ink. The encoder-dater 15 comprises a stamp having 5 adjustable digits 21 for setting in the date i.e., month, day and year, in the manner shown on FIG. 1 along with a permanently affixed stamp portion 23 containing the identification number of the business to which the stamp is assigned. It is possible to use settable digits for the portion 23. However, such could lead to inadvertent error. The ink used in the stamp pad 17 is preferably a red, violet, or blue indelible ink.

Figure 3:
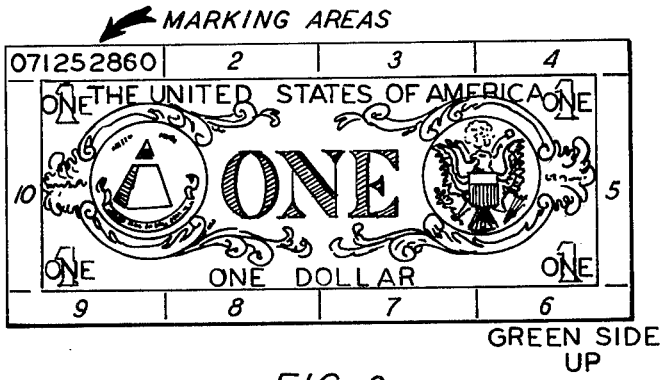
FIG. 3 is a drawing of a piece of currency illustrating the marking areas on which the code of FIG. 1 is placed.

In accordance with FIG. 3, the border of the bill is divided up into ten sections on each side. These divisions are, of course, not physically made but the user of such a system will given a guide such as FIG. 3 to indicate to him where the markings are to be made. The length taken up by the digits on the encoder-dater 15 of FIG. 2 is selected to permit four stampings across each long border of the bill. In accordance with the present invention it is preferred that the green side be stamped first and then the opposite side of the bill. However, this is simply a matter of convenience and standardization; stamping can be started on the other side.

In operation, the one or more encoder-daters 15 which the merchant has are each morning set up with the proper date. As money is received, it will be marked on the borders of the bills, green side first. Thus, the merchant receiving a bill which has not previously been marked, will mark it in the area indicated as 1 on FIG. 3. If the bill has been marked, for example, twice before he will place his mark next to those two marks causing it to be applied to the area designated as 3 on the figure. It the green side of the bill is completely filled up with 10 markings he will turn it over and start marking in the upper left hand corner of the other side. Thus, all the money which the merchant has on hand will be coded with the date and his code number. Should a thief come in and rob that money, it can easily be identified when the thief trys to pass it. After he has been robbed, the merchant will notify the police of the fact and of his identification number. This information can be widely disseminated to all those who might be likely to receive money. As a result the possibility of detection of the thief is increased and once detected the money can be returned to its proper owner.

It is also preferred that, in accordance with the present invention, signs be installed by the merchant at his place of business indicating that he employs the system of present invention. Doing this will discourage any perspective thief since the thief will realize that if he steals money from that establishment he might have trouble passing it.

Thus, an improved system for marking money to aid in the prevention of theft, and to aid in the capture of thieves and the return of money should a theft occur has been shown. Although specific embodiments have been illustrated and described, it will be obvious to those skilled in the art the various modifications may be made without departing from the spirit of the invention which is intended to be limited solely by the appended claims.

What is claimed is:

1. A method of preventing theft, detecting theft and permitting stolen money to be traced to its source comprising:

stamping on the edge of each bill received by a business in indelible ink, a two part code including a date and a code indentifying the business, utilizing a stamp having a width less than one-quarter the length of a bill, said stamping being done successively by a plurality of businesses with said stamping done in sequence by each business as it receives the bill with the first business to stamp the bill starting at the upper lefthand edge of one side of the bill and continuing stamping on the other side when the one side is filled permitting each bill to be stamped ten times on each side whereby, upon a theft, the date and identifying number of the last business to have had the bill can be distributed permitting others receiving the money to identify it as stolen and to permit return of the money to the proper owner when the theft is detected.

2. The method of claim 1 wherein marking is done first on the green side.

3. The method according to claim 1 and further including the step of installing identifying markers at the location of the business to warn prospective thieves that the method of the present invention is being used by the business.

* * * * *